US008943936B2

(12) United States Patent
Borenstein et al.

(10) Patent No.: US 8,943,936 B2
(45) Date of Patent: Feb. 3, 2015

(54) METHOD AND APPARATUS FOR FORMING A SHEET OF FOIL

(71) Applicants: Moran Borenstein, Givatayim (IL); Maor Gross, Givatayim (IL)

(72) Inventors: Moran Borenstein, Givatayim (IL); Maor Gross, Givatayim (IL)

( * ) Notice: Subject to any disclaimer, the term of this patent is extended or adjusted under 35 U.S.C. 154(b) by 1 day.

(21) Appl. No.: 13/899,027

(22) Filed: May 21, 2013

(65) Prior Publication Data

US 2013/0239641 A1 Sep. 19, 2013

Related U.S. Application Data

(63) Continuation-in-part of application No. 11/716,972, filed on Mar. 13, 2007, now abandoned.

(51) Int. Cl.
*B26D 3/00* (2006.01)

(52) U.S. Cl.
USPC ..... 83/56; 83/76.9; 83/213; 225/3

(58) Field of Classification Search
USPC ..... 83/13, 56, 208, 213, 76.9; 225/3; 72/20.2, 28.2
See application file for complete search history.

(56) References Cited

U.S. PATENT DOCUMENTS 3,860,803 A * 1/1975 Levine ..... 700/98
4,224,954 A 9/1980 Stahl
4,508,524 A * 4/1985 Romagnoli ..... 493/11
5,442,983 A * 8/1995 D'Angelo et al. ..... 83/56
6,536,319 B1 * 3/2003 Boss ..... 83/247
6,705,979 B1 * 3/2004 Sakaguchi et al. ..... 493/82
6,907,806 B1 * 6/2005 Okamoto et al. ..... 83/76.8
6,994,408 B1 * 2/2006 Bunnell ..... 312/34.8
7,392,684 B2 * 7/2008 Iwashita et al. ..... 72/454
7,793,882 B2 * 9/2010 Reinsel et al. ..... 242/563
8,671,538 B2 * 3/2014 Ayabakan et al. ..... 29/407.08
2002/0148273 A1 * 10/2002 McKinney et al. ..... 72/379.2
2002/0171192 A1 * 11/2002 Sato ..... 270/58.08
2003/0044560 A1 * 3/2003 Kennedy ..... 428/42.3
2003/0116003 A1 * 6/2003 Kapiloff ..... 83/649
2008/0115550 A1 * 5/2008 Walle ..... 72/181
2008/0257122 A1 * 10/2008 Ratz ..... 83/13

* cited by examiner

*Primary Examiner* — Sean Michalski

(74) *Attorney, Agent, or Firm* — Roach Brown McCarthy & Gruber, P.C.; Kevin D. McCarthy

(57) ABSTRACT

Apparatus for forming a bent sheet of foil, comprising a holder for holding a roll of foil; a motor for horizontally feeding the foil from the roll; a bending station for providing the fed foil with an angled portion; a controller for controlling a desired length of foil to be fed by commanding operation of said motor; and a cutting station for cutting said fed foil at said desired length, whereby to form constant length sheets of said foil. The controller is operable to command operation of the motor to sequentially feed the foil a first distance corresponding to a selected longitudinal dimension of the angled portion and then to feed the foil a second distance corresponding to a selected longitudinal dimension of a foil sheet to be formed.

8 Claims, 6 Drawing Sheets

METHOD AND APPARATUS FOR FORMING A SHEET OF FOIL

The present invention is a continuation-in-part of U.S. patent application Ser. No. 11/716,972 filed on Mar. 13, 2007 which is entitled "METHOD AND DEVICE TO CUT ALUMINUM FOIL".

FIELD OF THE INVENTION

This invention is in the field of cutting machines and in particular directed to cutting rolls of foil to predetermined lengths for use for example when coloring hair.

BACKGROUND OF THE INVENTION

It is well known in the hairdressing trade and also by the public at large that many people, usually ladies, wish to change the color of their hair. Some people wish to dye all their hair, but there are many, particularly those of the younger generation, who wish to have special effects. These could be streaky, chunky, stripes or even in artistic forms of drawings. In order to ensure complete separation of color between the various locks or strands of hair it is common practice to dye the differing locks by applying dye or any other coloring agent to the hair and then wrapping selected strands by a sheet of aluminum foil.

The same practice is also used when wishing to lighten the color of the hair and have differing effects. In this case also, the locks of hair are separated out into different portions, laid on a corresponding strip of aluminum foil, dye or bleach is applied to selected strands, and then the foil is wrapped or folded around the selected strands of hair.

This practice of wrapping the hair in foil has been found to have at least two benefits. The first is that the bleaching or the coloring takes permanent effect faster. This is probably due to the heat that is conducted through the aluminum foil, which is wrapped around these corresponding strands of hair and insulates the volume defined by the wrapped foil.

The other is that it physically prevents the dye from coloring the adjacent strands of hair that one does not wish to color. This second effect is even more important when the customer wishes not only to have a streak effect in her natural color but wishes to display her hair by a two-color arrangement.

This process is repeated for each bunch of hair strands to be treated.

As previously mentioned it has also been found that the dye sets or takes permanent effect faster when heat is applied. In some salons its has been the practice to use a hand-held blow-dryer, but this practice has, on occasion, led to negative and harmful results, including burning of the hair and skin due to a chemical reaction between the heat being applied and the chemicals in the dye. By using aluminum foil, the temperature of the body heat of the person whose hair is being treated is sufficiently high to help the setting process of the dye on the hair.

Another method to color the hair is carried out by wrapping or folding colored aluminum foil around the individual strands of hair. This helps to set the dye onto the hair.

It is well known in the art, especially when using liquid dyes, that the foil has to be applied immediately after the dye has been applied. This is very difficult, especially when applying dye to one's own hair. Also in a professional salon, the stylist wishes to apply the aluminum foil quickly, but is faced with the problem of having both hands occupied, one holding strands of hair separate and the other applying the dye. The stylist now has the additional difficulty of trying to tear of a piece of foil and wrap or fold it around the strands of hair. A customer may need more than a hundred separate sheets of aluminum foil wrapped about different strands of hair at one sitting in order to adequately treat her hair. The hair stylist is therefore faced with the time consuming task of manually cutting each sheet of foil and wrapping or folding the cut foil about a selected bunch of hair strands.

Other methods have been tried to circumvent this difficulty, but with varying measures of success. Some of these include having the foil being packed in pre-cut lengths, but this is not desirable as the length of hair being dyed is variable and hence the foil is required to be of varying lengths. Also, this method is difficult to remove the cut sheets one at a time with one hand.

It is an object of the present invention to provide apparatus for cutting aluminum foil to a predetermined and controllable size.

It is another object of the present invention to provide a method and apparatus for automatically cutting hair treatment aluminum foil

SUMMARY OF THE INVENTION

The present invention is directed to apparatus for forming a bent sheet of foil, comprising a holder for holding a roll of foil; a motor for horizontally feeding said foil from said roll; a bending station for providing said fed foil with an angled portion; a controller for controlling a desired length of foil to be fed by commanding operation of said motor; and a cutting station for cutting said fed foil at said desired length, whereby to form constant length sheets of said foil.

The controller is operable to command operation of the motor to sequentially feed the foil a first distance corresponding to a selected longitudinal dimension of the angled portion and then to feed the foil a second distance corresponding to a selected longitudinal dimension of a foil sheet to be formed.

The bending station preferably comprises a vertically displaceable force applier normally vertically spaced from said fed foil, and one or more vertical drive units for vertically displacing said force applier a predetermined distance, causing a free end portion of the fed foil to bend continuously in response to a force applied by said force applier until said force applier is vertically displaced to a maximum extent and the angled portion assumes a predetermined angle with respect to the fed foil In one aspect, the force applier is a rigid board that laterally extends across the entire width of the fed foil and that has a rounded top for preventing damage to the foil when applying the force to the free end portion of the foil.

In one aspect, the force applier is operable to slide along a surface of a stationary element, to define the predetermined angle of the angled portion, such as a substantially perpendicular angular disposition with respect to the fed foil.

The apparatus preferably comprises a pressing station for continuously or temporarily applying a clamping force to the fed foil.

In one aspect, the pressing station comprises an upper roller and a lower roller which are sufficiently close to each other so as to remain in constant pressing relation with the foil and to apply a clamping force thereto, wherein one of said upper roller and lower is driven by the motor which is commanded by the controller.

In one aspect, the pressing station comprises a stationary element and a displaceable element that is vertically separable from said stationary element, said displaceable element being controllably raised and lowered by means of a vertical drive in response to commands transmitted thereto by the controller so as to be able to brought in pressing relation with said stationary element while frictionally engaging the foil to apply a clamping force thereto.

The invention therefore provides a foil dispenser. The dispenser could accommodate different widths of foil even though the width used in the hairstyle industry is currently a standard width. The dispenser has a place to hold the roll of foil and allow it to turn on its longitudinal axis when the dispenser pulls the said foil for cutting. The user presses a number-pad to instruct the machine to cut the foil strip to a particular length. Standard lengths could have code numbers or letters for example "A" could be pre-programmed to cut ten centimeter lengths and "B" 15 centimeter lengths and so on. Another number-pad or a second mode on the same number-pad could be used to choose the number of strips of foil of the chosen length. The start button would start the cutting process that would include pulling the programmed amount of foil to be pulled off the roll and then the foil is cut to size. The cut pieces would lie one on top of the other ready to be taken by the hair stylist.

The foil could be pulled off the roll by two rollers positioned parallel to the roll of foil, touching each other along their length where the top roller would turn clockwise when looking from the right of the device. The bottom roller would roll anti-clockwise. An electronic eye or laser beam could be used to measure the length of foil and when the required length has been pulled from the roll, the foil is cut for example by a guillotine device. The length measurement could be done by the said rollers whereby each complete turn of the roller would represent a fixed length. After a given number of turns a pulse would be sent to the cutting device to cut the foil. After the programmed number of cuts the cutting device and rollers would switch off as that program of cut foil would be complete.

A tray could be positioned to collect the cut strips of foil. The machine would be placed close to the user so that he could program the cutting details, operate the device and conveniently remove cut pieces when needed.

The above described machine could also be operated partially or entirely manually. That is to say a ratchet lever could pull aluminum foil off the roll onto a tray with measurements of length printed thereon. When the required length had been reached the manually operated guillotine would be used to cut the foil. The obvious disadvantage of this manual embodiment is the time needed to attend to this task bearing in mind one hair dying job can use more than a hundred pieces of foil.

The usual actions of the stylist once he has a strip of foil of the correct size is to hold the desired amount of hair along the length of the foil having cupped the width of the foil making a long "U" shape. Then while holding the foil with the hair resting along its cupped length in one hand he uses his other hand to paint on the die with the other hand. Finally, he closes and crimps the width of the foil around the hair to hold it in place while the die sets on the hair. As mentioned above the setting process is assisted by the heat of the body heating the die inside the closed foil.

Another embodiment of this invention could be to dispense the foil from a roll and feed it forward over a flexible surface. The hair could then be laid on the said foil, colored manually or by the machine with the required dye and the flexible surface would then close around the hair, wrapping it into the strip of foil.

The invention could be of a mechanical, manual mechanism. A modification of this could be that it has an electrically-powered mechanism. This could be either mains-operated, or powered by a battery.

A modification of the feed method could be that the wheel on which the foil is loaded is connected to an electrical motor. By the stylist pressing a button on the device a motor causes the roll of foil to rotate thereby releasing the foil. Another modification could be that the speed of the said motor could be variably controlled, this being done by a pistol-type trigger button whereby the stylist squeezing harder on the said trigger button the speed of the motor increases. Releasing the said trigger button completely will stop the motor rotating.

A further modification could be to allow the motor direction to be reversible, thus allowing the stylist to take up any slack in the foil should too much have been released.

The invention is designed so as to cut the aluminum foil at any desired length. The cutting mechanism is also controlled by the stylist. This mechanism could be of a mechanical type. A modification of this could be that the cutting mechanism is electrically operated.

The invention could also be modified to automatically seal the foil around the lock. There are a number of methods by which this could be done. One method could be by crimping every few centimeters. Another possibility could be by dropping an elastic band, which is also loaded, at the flexible end of the dispenser. Another possibility could be that the elastic bands are within a magazine, situated over the end of the dispenser, and every few centimeters the elastic band is released and stretched around the foil. Another possibility could be that a wire-type staple is released and stapled around the foil every few centimeters. The control of the sealing process, with all of the different possibilities of sealing, could be manually controlled, through the stylist pressing an additional button on the dispenser. The sealing could also take place automatically after every few centimeters. A further modification of this invention could be to allow the stylist the possibility of the choice of either manually sealing or automatically sealing, with the added possibility of a manual override.

This invention will enable the user to choose the length of foil strips, the number of strips and cut them automatically. It will save a considerable amount of time for the stylist and for the client, as these strips cannot be prepared except shortly before the dying process. Hair stylists usually seek ways to work more proficiently and serve more clients in the work day.

In another embodiment of this invention it could allow hair coloring to be done by the individual by himself without the need for another to do the dying for him. This device could be used at home.

The present invention is also directed to a method for forming a bent sheet of foil, comprising the steps of selecting desired dimensions of a sheet of metallic foil to be formed; activating a motor for rotatably driving a roll of said foil, in order to horizontally feed said foil from said roll until an unsupported free end of said foil has a first predetermined longitudinal dimension; vertically displacing a laterally extending force applier until said force applier sufficiently contacts said free end having said first longitudinal dimension to achieve an angled foil portion of a predetermined angle with respect to said fed foil; retracting said force applier; reactivating said motor until said foil is fed for a second longitudinal dimension; and operating a cutting station for cutting said fed foil to form a foil sheet of said second longitudinal dimension.

In one aspect, the foil is fed between an upper roller and a lower roller which are sufficiently close to each other so as to remain in constant pressing relation with the foil and to apply a clamping force thereto, wherein one of said upper roller and lower is driven by the motor.

In one aspect, the motor drives a holder on which is mounted the roll of foil and a clamping force is temporarily applied to the fed foil. A clamping force is temporarily applied to the fed foil by operating a pressing station comprising a stationary element, a displaceable element that is vertically separable from said stationary element, and a vertical drive for raising and lowering said displaceable element, so that when said displaceable element is brought in pressing relation with said stationary element, the foil is frictionally engaged while the clamping force is applied.

Accordingly, the method further comprises the steps of vertically displacing the force applier, after feeding the foil to achieve the first dimension and applying the clamping force; retracting the force applier and releasing the clamping force after forming the angled foil portion; feeding the foil to achieve the second dimension; reapplying the clamping force; and operating the cutting station.

The method may be automatically performed in synchronization with a controller, after entering the selected dimensions and pressing a start button.

The method may further comprise the steps of receiving the formed sheet on a supporting element and delivering the sheet to a collection area.

BRIEF DESCRIPTION OF THE DRAWINGS

The accompanying drawings, which are incorporated in and form a part of this specification, illustrate embodiments of the invention and, together with the description, serve to explain, by way of example only, the principles of the invention.

DETAILED DESCRIPTION OF PREFERRED EMBODIMENTS

Figure 1:
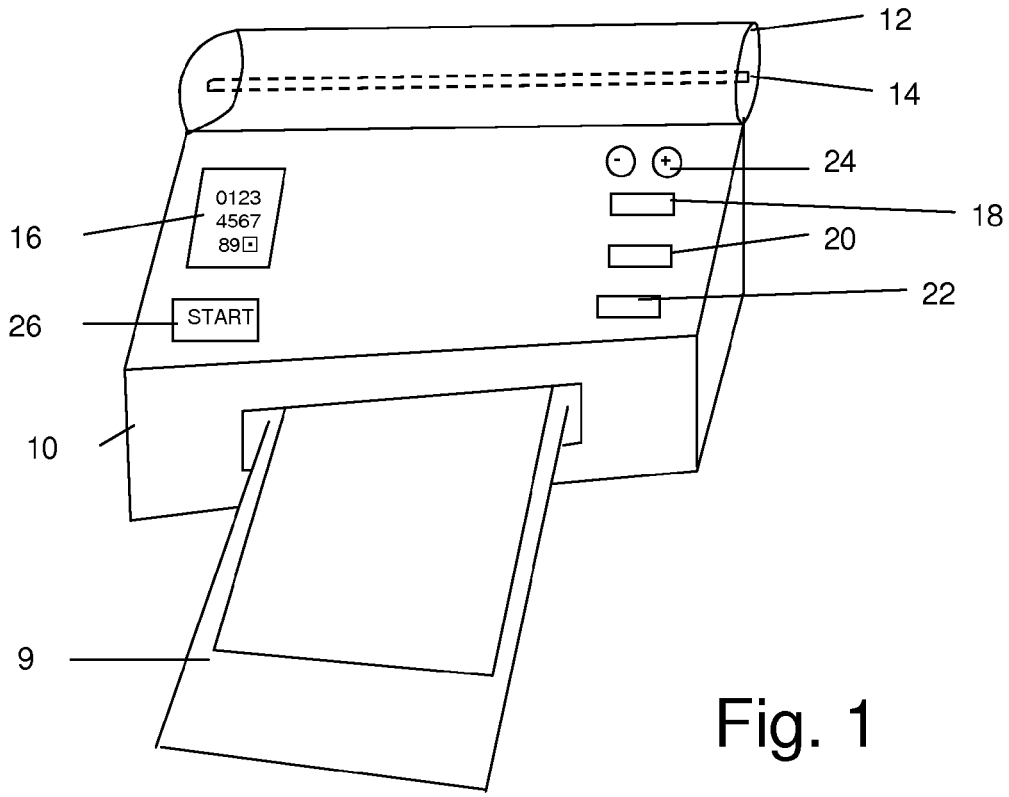
FIG. 1 is a perspective view of foil cutting apparatus, according to one embodiment of the invention.

FIG. 1 shows a foil cutting apparatus 10, according to one embodiment of the invention. Foil cutting apparatus 10 comprises a foil roll holder 12 towards the back thereof. This could be a "U" shaped holder or a have a rod 14 passing through the hollow roll to hold the foil roll along its length thereby reducing friction when it turns.

Number-pad 16 is for programming the functions of the machine 10, for example the length of the foil strips and the number of those strips to be cut. This could be programmed using the mode buttons, for example the length selecting button 18 and the strip quantity selecting button 20. The input information could be displayed on a screen 22. The speed of the feed and cutting process could be increased and decreased using the plus and minus buttons 24. Once the factors have been entered, the user presses the start button 26 to start the machine according to the programmed information. The start button could be of the toggle kind and could be pressed again to stop the machine if it were necessary before the end of the programmed run of cutting. At the end of the programmed run the machine would automatically stop working.

Figure 2:
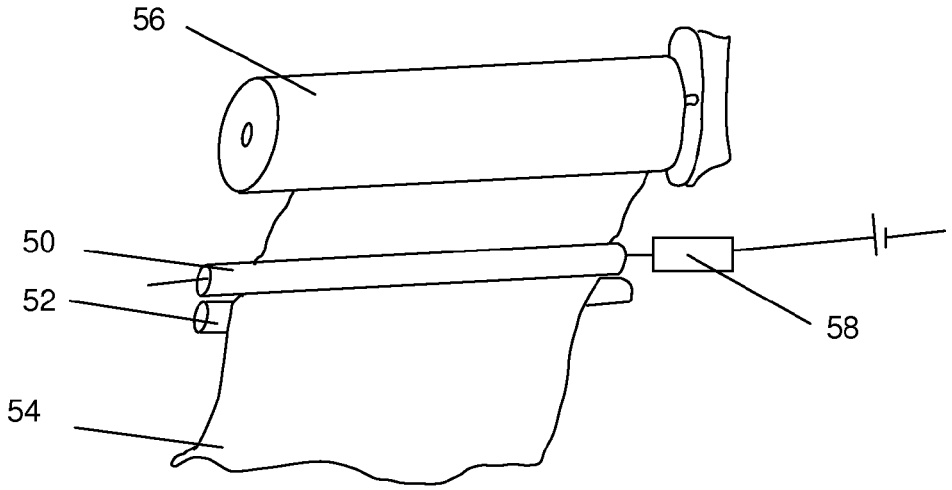
FIG. 2 is a perspective view of a roll of foil and driving rollers used in conjunction with the apparatus of FIG. 1.

FIG. 2 shows the rollers 50 and 52 that pull the aluminum sheet 54 off the roll of aluminum foil 56 and direct it toward the cutting device. The lower roller 52 could be free to roll and not be motorized. Alternatively, it could be motorized to reduce strain on the aluminum sheet 54 as it passes through the rollers. If motorized, the two rollers 50 and 52 would turn in opposing directions in order to ease the pull of the aluminum off the roll 56. If roller 52 were not motorized, the upper roller 50 would have to press with pressure against the lower roller 52 in order to pull the foil off the roll 56.

The motor 58 could be driven by mains or battery electricity 60. The motor 58, the top roller 50 and the foil cutting device could be connected to the length programmer so that when the roller has turned a certain number of turns which is equivalent to a length of foil passing through, then the cutting device would cut the foil. Alternately an electronic eye or laser beam could be connected to the cutting device and be used for the length measurement and giving the electrical impulse to the cutting device to cut.

The cutting device and the motor 58 could be connected to a counter so that when the required number of foil sheets had been cut, the motor would stop feeding foil and the cutter would stop cutting.

Figure 3:
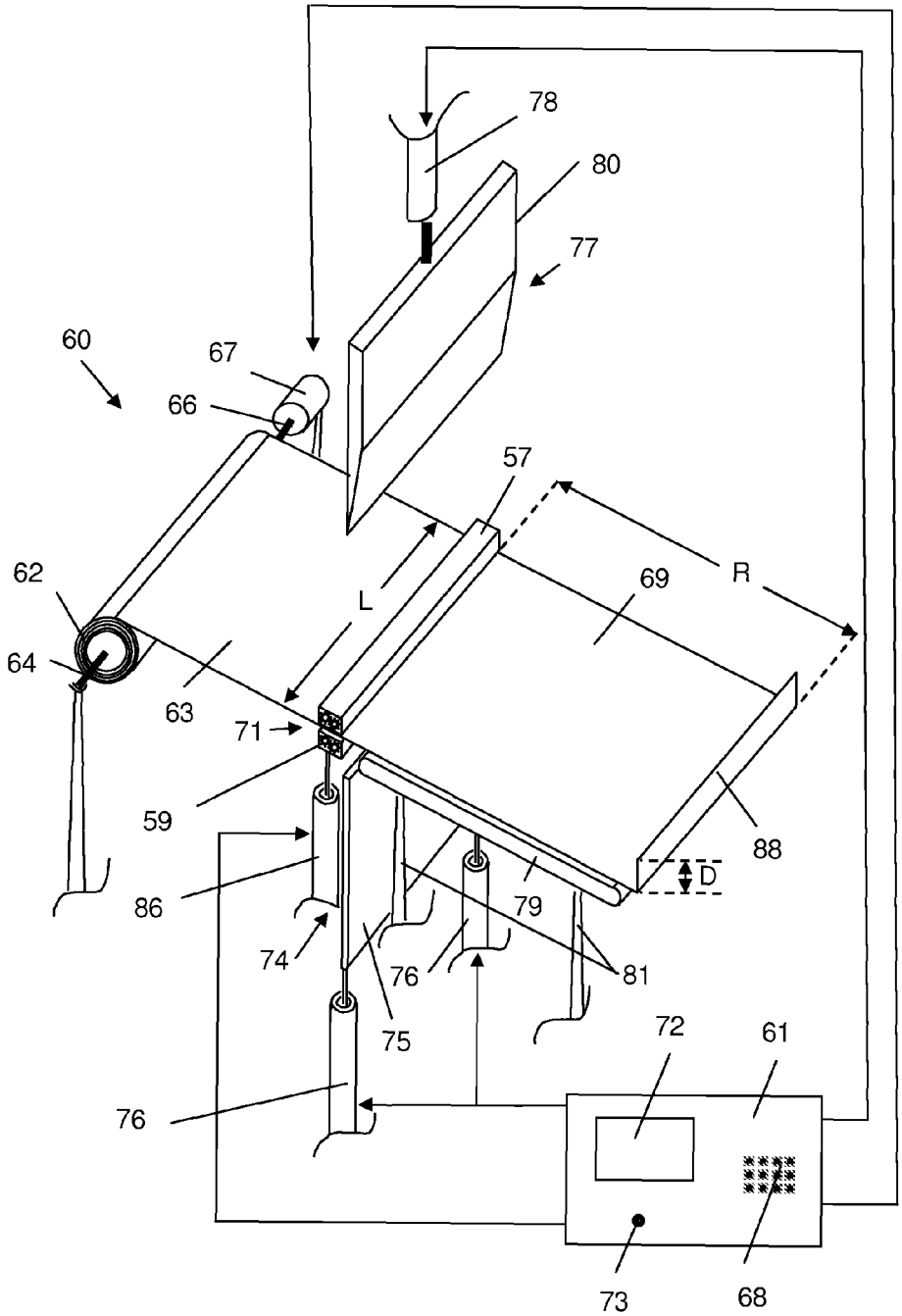
FIG. 3 is a perspective view of foil cutting apparatus according to another embodiment of the invention, schematically illustrating components that are in electrical communication with the controller.
Figure 4:
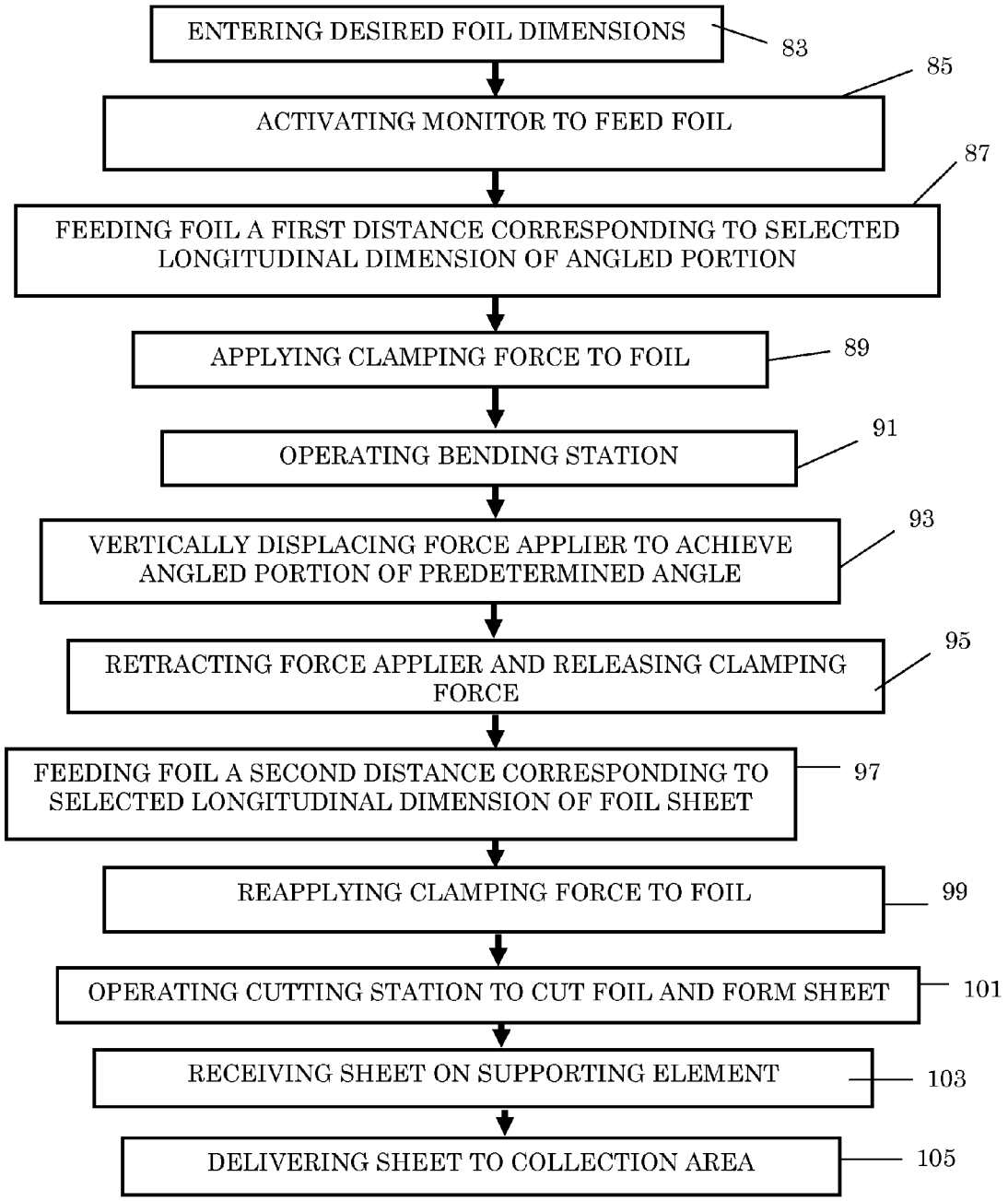
FIG. 4 is a flow chart illustrating the various steps for forming a bent sheet of foil, according to one embodiment of the invention.

FIG. 3 schematically illustrates another embodiment of the invention wherein foil cutting apparatus 60 is operable to both automatically cut a sheet of foil to a predetermined length, as well as to automatically form a prefabricated angled foil portion, thereby considerably reducing the time needed by a stylist to perform a hair treatment operation of a selected bunch of hair strands.

Roll 62 of foil, which is generally aluminum foil but may also be another type of metallic foil such as copper foil, is rotatably mounted on a cylindrical horizontally disposed holder 64, which is connected to shaft 66 of motor 67. When motor 67 is operated, for example by activation button 73 of controller 61, foil 63 is fed from an upper portion of roll 62 and sequentially accesses a foil pressing station 71, a foil bending station 74, and a cutting station 77. The formed sheet of foil 69 may be received on a substantially horizontally disposed supporting element 79, from which sheet 69 is discharged to a collection area (not shown). Supporting element 79 may be fixated by stand 81.

Although pressing station 71 is shown to be significantly spaced from roll 62, it will be appreciated that pressing station 71 may be spaced from roll 62 by a distance of only a few centimeters when foil 63 is very thin, to avoid the formation of creases or wrinkles in the unsupported foil portion.

Controller 61 is used to control the operation of motor 67. Prior to a sheet forming operation, an operator enters desired dimensions of the sheet via keyboard 68, or any other suitable input device. Entered information or information related to the sheet forming operation is displayable on screen 72 Controller 61 is operable to convert the operational speed of motor 67 into a longitudinal feed speed of foil 63 at, or downstream from, pressing station 71, depending on the thickness and type of material being fed. A predetermined length of the free end of the foil at a given station may therefore be derived from the feed speed of the foil. Accordingly, the various steps of a sheet forming operation may be synchronized by controller 61 in response to the number of revolutions of motor 67.

Following unwinding of roll 62 during a sheet forming operation, controller 61 may adjust the speed of motor 67 to compensate for the reduced diameter of the roll, after knowing the starting diameter of roll 62, the feed speed of foil 63, and the number of motor revolutions made during the sheet forming operation.

Alternatively, controller 61 may maintain the same motor speed for the reduced-diameter roll while adjusting the feed speed of the foil, in order to timely command initiation of the various steps of the sheet forming operation.

The sheet forming operation will now be described with reference to FIGS. 3-6.

After the operator enters a desired foil sheet length and a desired angled portion length in step 83 and motor 67 is activated in step 85, the free end of foil 63 is fed in step 87 between two spaced elements of pressing station 71 until the free end is longitudinally spaced downstream from pressing station 71 by a predetermined distance D corresponding to the selected length of the angled portion 88, whereupon the motor is temporarily deactivated.

Pressing station 71 comprises a stationary abutment element 57 and a displaceable element 59 that is vertically separated from abutment element 57. Elements 57 and 59, which are shown to be rectangular but may assume any other desired shape, extend laterally across cutting apparatus 60, and are sized to have a lateral dimension L substantially equal to that of foil 63. Displaceable element 59 is connected to a piston driven mechanism 86, or any other vertical drive, in order to be controllably raised and lowered in response to commands by controller 61. Displaceable element 59 is shown to be positioned below abutment element 57, but also may be configured to be positioned thereabove when abutment element 57 is positioned below the fed foil.

After the foil ceases to be longitudinally advanced, displaceable element 59 is commanded to be vertically displaced in step 89 until it contacts foil 63 and presses on abutment element 57, frictionally engaging the foil to apply a clamping force thereto during steps of the sheet forming operation. Displaceable element 59 remains in abutting relation with element 57 for a predetermined duration.

If so desired, motor 67 may be commanded to rotate in an opposite direction for a predetermined revolution, or fraction of a revolution, when the clamping force is applied in order to increase the foil tension.

Controller 61 then commands operation of bending station 74 in step 91. Bending station 74 comprises a planar rigid board 75 that extends laterally across cutting apparatus 60 and one or more vertical drive units 76 for vertically displacing board 75. Following a predetermined period of time after displaceable element 59 has been set in abutting relation with abutment element 57, the one or more vertical drive units 76 are actuated to raise board 75 a predetermined distance above pressing station 71.

Figure 5:
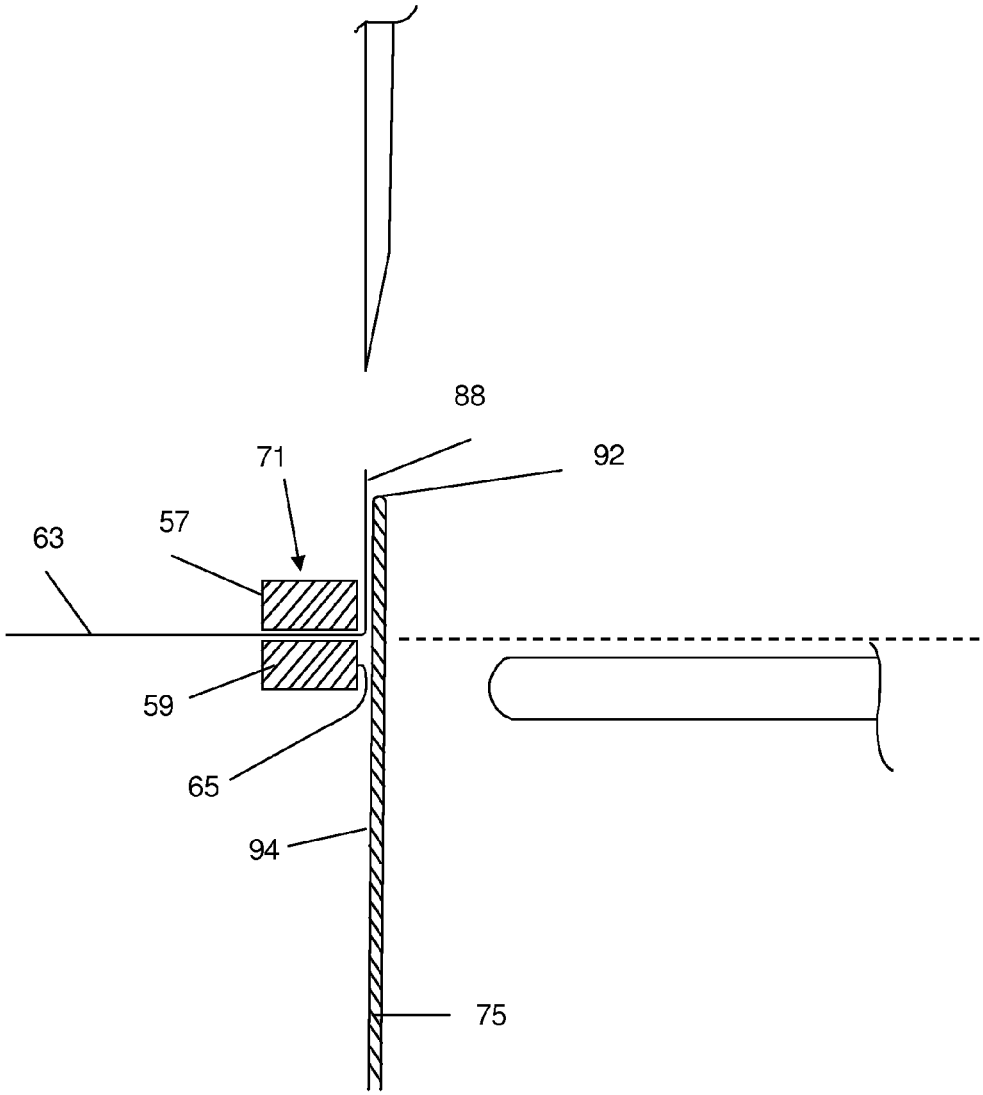
FIG. 5 is a partial front view of the apparatus of FIG. 3, showing an element of the bending station in force applying relation with a free end of the fed foil.

When board 75 is raised, as shown in FIG. 5, the top 92 thereof, which is preferably rounded to prevent unwanted tearing of the foil, or other damage thereto, contacts the free end portion of foil 63 and urges the same to bend with respect to the remaining portion of foil 63. The free end portion continues to bend until board 75 is fully raised and the formed angled portion 88 assumes a substantially perpendicular angular disposition in step 93 with respect to foil 63. The drive units 76 adapted to vertically displace board 75 may be provided with biasing means, in order to adjust the spacing between board 75 and elements 57 and 59 of pressing station 71. The upstream edge 94 of board 75 is preferably smooth in order to prevent damage to angled portion 88.

It will be appreciated that bending station 74 may be configured to form an angled portion 88 of any other desired angle with respect to foil 63. For example, board 75 may be disposed at a selected angle with respect to a horizontal plane and the downstream edges 65 of elements 57 and 59 may be formed with the same angle, to ensure formation of angled portion 88 when board 75 slides along downstream edges 65 of elements 57 and 59.

After angled portion 88 is formed, drive units 76 are actuated to lower board 75 below elements 57 and 59 in step 95. Motor 67 is operated for a predetermined duration in step 97 at a predetermined time after actuation of drive units 76 to lower the board 75 and of drive units 86 to lower the displaceable element 59, in order to advance foil 63 in the feed direction by a distance R substantially equal to the length of the foil sheet end product 69. Motor 67 is then deactivated and displaceable element 59 is set in abutting relation with abutment element 57 in step 99, whereupon controller 61 commands operation of cutting station 77 in step 101.

Figure 6:
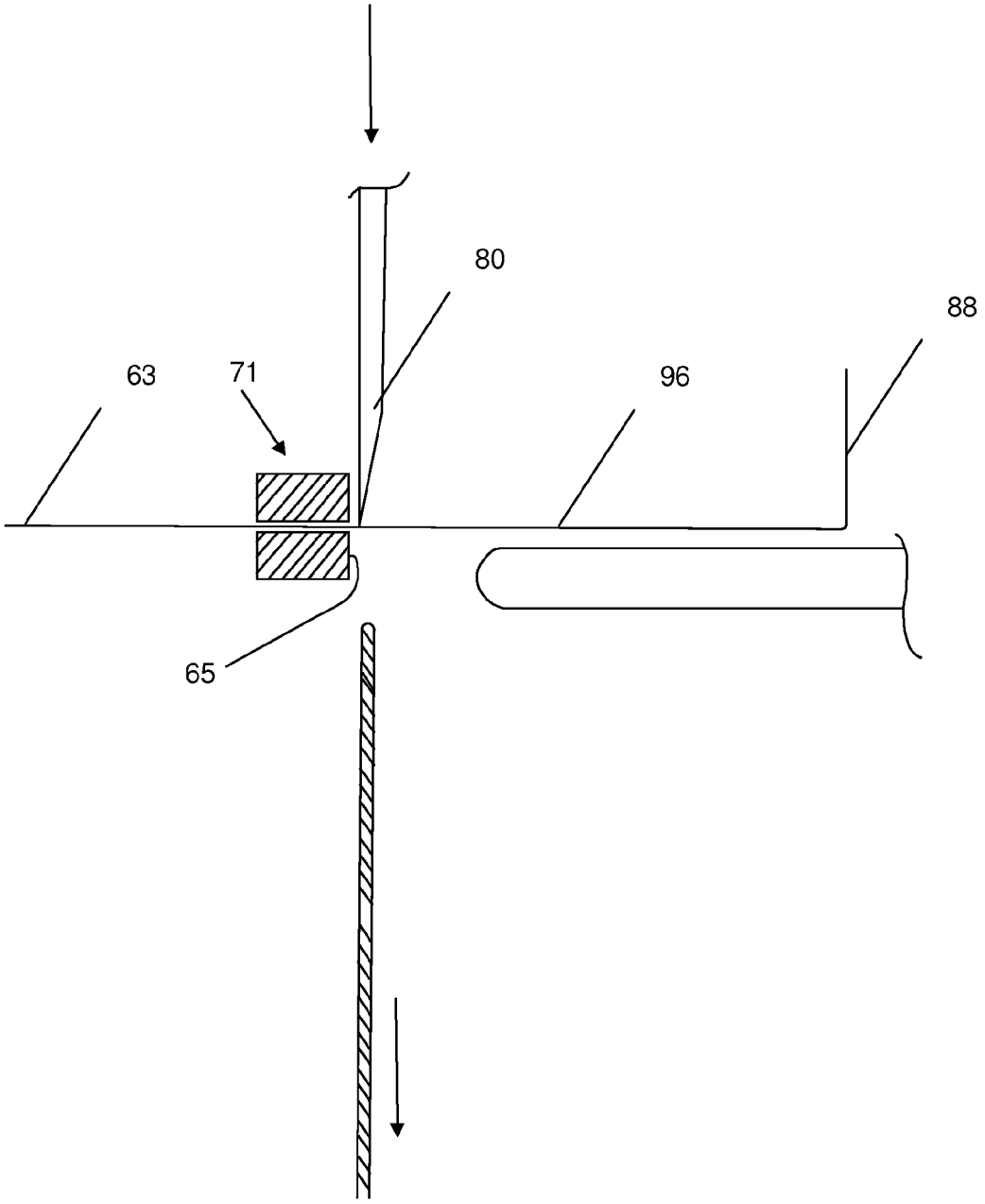
FIG. 6 is a partial front view of the apparatus of FIG. 3, showing a subsequent step of the bent sheet forming method, after the element of FIG. 5 has been retracted.

During operation of cutting station 77, drive unit 78 sufficiently lowers knife blade 80 located vertically above the foil 63 so as to cut its extended free end portion 96 very close to downstream edges 65, as shown in FIG. 6, e.g. at a distance of less than 0.5 cm therefrom, depending on thickness of foil, and then raises blade 80.

Alternatively, blade 80 is laterally spaced from the foil 63 and drive unit 78 is adapted to laterally displace blade 80 while cutting free end portion 96.

The formed sheet of foil 69 is received on supporting element 79 in step 103 after blade 80 returns to its original position and is then delivered to a collection area in step 105. Supporting element 79 may have an inclined portion, to facilitate gravitational delivery of the formed sheet 69 to a collection area. Alternatively, supporting element 79 may have one or more driven rollers, or other discharge element, for delivering sheet 69 to the collection area.

Each step of the aforementioned method may be individually activated or deactivated by the operator, or alternatively, the various steps may be synchronized together by means of the controller.

The quality of a hair treatment operation is increased and the required time for it to be performed is considerably reduced when using the prefabricated foil sheet described hereinabove. The need to individually cut a sheet for each bunch of hair, regardless of the hair length or the thickness of the bunch, is obviated by the method and apparatus of the invention. As the angled portion is formed with a defined and accurate fold line at the interface with the sheet, the stylist simply places a selected bunch of hair on the sheet, applies the treatment liquid, and folds the angled portion on the corresponding fold line as many times as necessary to form a hair retaining envelope which prevents leakage of treatment liquid therefrom.

Figure 7:
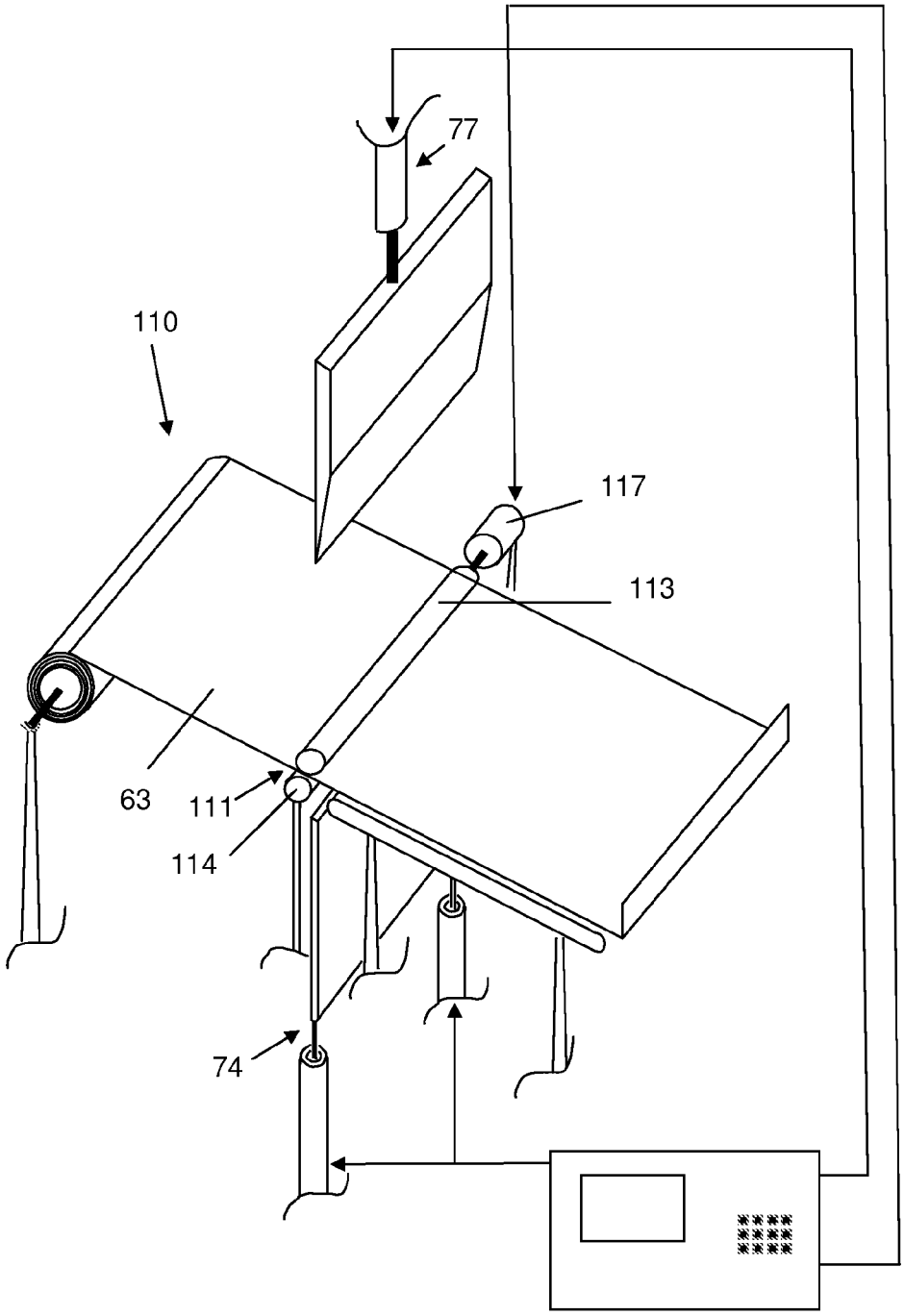
FIG. 7 is a perspective view of foil cutting apparatus according to yet another embodiment of the invention, schematically illustrating components that are in electrical communication with the controller.

FIG. 7 illustrates another embodiment of the invention wherein foil 63 of apparatus 110 is fed by means of a motor 117, which drives a roller 113 of pressing station 111. Foil 63 is fed between upper roller 113 and lower roller 114, which are sufficiently close to each other so as to remain in constant pressing relation with the foil and to apply a clamping force thereto. The other structure of the apparatus is identical.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A method for forming a bent sheet of foil, comprising the steps of:

a) selecting desired dimensions of a sheet of metallic foil to be formed;

b) activating a motor for rotatably driving a roll of said foil, in order to horizontally feed said foil from said roll until an unsupported free end of said foil has a first predetermined longitudinal dimension;

c) vertically displacing a laterally extending force applier until said force applier sufficiently contacts said free end having said first longitudinal dimension to achieve an angled foil portion of a predetermined angle with respect to said fed foil;

d) retracting said force applier;

e) reactivating said motor until said foil is fed for a second longitudinal dimension; and f) operating a cutting station for cutting said fed foil to form a foil sheet of said second longitudinal dimension.

2. The method according to claim 1, wherein the motor drives a holder on which is mounted the roll of foil and a clamping force is temporarily applied to the fed foil.

3. The method according to claim 1, wherein the foil is fed between an upper roller and a lower roller which are sufficiently close to each other so as to remain in constant pressing relation with the foil and to apply a clamping force thereto, wherein one of said upper roller and lower is driven by the motor.

4. The method according to claim 2, wherein a clamping force is temporarily applied to the fed foil by operating a pressing station comprising a stationary element, a displaceable element that is vertically separable from said stationary element, and a vertical drive for raising and lowering said displaceable element, so that when said displaceable element is brought in pressing relation with said stationary element, the foil is frictionally engaged while the clamping force is applied.

5. The method according to claim 4, further comprising the steps of:

a) vertically displacing the force applier, after feeding the foil to achieve the first dimension and applying the clamping force;

b) retracting the force applier and releasing the clamping force after forming the angled foil portion;

c) feeding the foil to achieve the second dimension;

e) reapplying the clamping force; and f) operating the cutting station.

6. The method according to claim 1, wherein steps b-f are automatically performed in synchronization with a controller, after entering the selected dimensions and pressing a start button.

7. The method according to claim 5, which is automatically performed in synchronization with a controller, after entering the selected dimensions and pressing a start button.

8. The method according to claim 1, further comprising the steps of receiving the formed sheet on a supporting element and delivering the sheet to a collection area.

* * * * *